US008875456B2

(12) United States Patent
Waddell

(10) Patent No.: US 8,875,456 B2
(45) Date of Patent: Nov. 4, 2014

(54) PRESSURE STABILIZATION DEVICE

(71) Applicant: Ply Gem Industries, Inc., Cary, NC (US)

(72) Inventor: Mark Waddell, Ridgeway, VA (US)

(73) Assignee: Ply Gem Industries, Inc., Cary, NC (US)

( * ) Notice: Subject to any disclaimer, the term of this patent is extended or adjusted under 35 U.S.C. 154(b) by 0 days.

(21) Appl. No.: 13/831,572

(22) Filed: Mar. 14, 2013

(65) Prior Publication Data

US 2014/0260010 A1 Sep. 18, 2014

(51) Int. Cl.
*E04B 7/14* (2006.01)
*E06B 7/02* (2006.01)

(52) U.S. Cl.
CPC ..... *E06B 7/02* (2013.01)
USPC ..... 52/209; 52/204.5

(58) Field of Classification Search
USPC ..... 52/209, 204.5, 204.52; 220/231, 303; 251/144
See application file for complete search history.

(56) References Cited

U.S. PATENT DOCUMENTS

| | | | | |
|---|---|---|---|---|
| 3,811,650 | A * | 5/1974 | Dehar | 251/144 |
| 4,193,575 | A * | 3/1980 | Burgess | 251/144 |
| 4,905,863 | A * | 3/1990 | Blomquist et al. | 220/231 |
| 5,368,181 | A * | 11/1994 | Myers | 220/303 |
| 6,553,728 | B1 * | 4/2003 | Zurn | 52/171.3 |
| 7,389,792 | B2 * | 6/2008 | Newberg | 137/551 |
| 7,418,998 | B2 * | 9/2008 | Aoki et al. | 165/104.33 |
| 2008/0019795 | A1 * | 1/2008 | Denton et al. | 411/383 |

* cited by examiner

*Primary Examiner* — Basil Katcheves
(74) *Attorney, Agent, or Firm* — Lathrop & Gage LLP

(57) ABSTRACT

A pressure stabilization device for an IGU includes a stem and a boot coupled to the stem. The stem includes an elongated shaft extending from a first end to a second end, and an element extending radially outward from the second end of the shaft, the element having a stronger magnetic attraction than the shaft. The boot includes a spout having a central bore receiving the shaft, a surface of the bore defining an interior groove, and a cap formed integrally with the spout and defining an exterior groove intersecting the interior groove of the spout.

19 Claims, 5 Drawing Sheets

PRESSURE STABILIZATION DEVICE

TECHNICAL FIELD

This specification generally relates to pressure stabilization devices for insulated glass units.

BACKGROUND

In the construction of double or triple pane windows, two pieces of glass are assembled and a perimeter spacer is sealed to each piece of glass, completing a sealed Insulated Glass Unit (IGU). The gas within may be atmospheric air or one of several gases that improve the thermal properties of the IGU. A desiccant material is also inserted along most spacers to absorb moisture that is inadvertently sealed within the IGU.

When an IGU is assembled at a particular altitude and then installed in a building with a different altitude, the net pressure difference from the inside to the outside results in a slight deflection on the glass. If the IGU is installed at a lower altitude than where it was assembled, then the glass panes will tend to deflect inward. If the IGU is installed at a higher elevation than where it was constructed, the glass panes will tend to bulge outward. In either case, a number of problems can result if the deflection is too great. For example, the IGU may experience seal failure, which can allow excessive moisture into the IGU, or a heat-amplifying "magnifying glass" effect when one or more of the panes have a highly reflective (low emissivity) thermal coating applied. These situations can require significant service costs to remedy.

There are some existing methods of addressing the problem of glass pane deflection. One method is to include expanding/retracting bladders, but these bladders must be extremely large to handle the volume of air that must be displaced in larger windows which makes this approach rather impractical. Another method is to include an extremely small capillary tube pierced into the IGU which can be sealed off when the IGU arrives at the installation site. These capillary tubes, however, often allow air of an unknown condition to fill and even cycle within the IGU during shipping resulting in contamination of the IGU. The tubes must also be sealed off in every IGU at the installation site, making the process tedious and more costly.

SUMMARY

This specification describes mechanisms and uses thereof that can be installed during assembly of an IGU, and which can act as a valve in order to alleviate the problems caused by deflection of the window panes resulting from different atmospheric pressures. The mechanisms described in this specification allow IGUs to be built with a common valve regardless of the altitude of the assembly location, and help to reduce and/or eliminate field servicing requirements unless the IGUs need to be adjusted in the field.

In one aspect, a pressure stabilization device for an IGU includes a stem and a boot coupled to the stem. The stem includes an elongated shaft extending from a first end to a second end, and an element extending radially outward from the second end of the shaft, the element having a stronger magnetic attraction than the shaft. The boot includes a spout having a central bore receiving the shaft, a surface of the bore defining an interior groove, and a cap formed integrally with the spout and defining an exterior groove intersecting the interior groove of the spout.

In another aspect, a window assembly includes an IGU including a first glass pane and a second glass pane separated by a window spacer, and a pressure stabilization device installed in the window spacer. The pressure stabilization device includes a stem and a boot coupled to the stem. The stem includes an elongated shaft extending from a first end to a second end, and an element extending radially outward from the second end of the shaft, the element having a stronger magnetic attraction than the shaft. The boot includes a spout having a central bore receiving the shaft, a surface of the bore defining an interior groove, and a cap formed integrally with the spout and defining an exterior groove intersecting the interior groove of the spout.

In some examples, the stem further includes a head extending radially outward from the first end of the shaft.

In some implementations, the shaft includes a cylindrical body tapering in diameter from the first end to the second end.

In some applications, the element includes a conical-shaped body, having a broad rounded base leading to side surfaces that converge to a narrow apex.

In some cases, the element and the shaft are fashioned from dissimilar materials.

In some applications, the stem includes a paramagnetic material.

In some applications, the element includes a ferromagnetic material.

In some cases, the boot is more flexible than the stem, such that forcing the stem against the boot causes the boot to deform.

In some examples, the spout terminates in an annular sealing ring configured contact a surface of the shaft to seal a distal end of the interior groove away from the intersection with the exterior groove of the cap.

In some implementations, the outer surface of the spout defines a radially extending retaining barb configured to allow the boot to be inserted into an opening of the insulated glass unit, and to inhibit removal of the boot from the opening.

In yet another aspect, a method of stabilizing the pressure of an IGU includes the installing a pressure stabilization device between a first and second glass pane of the IGU. The pressure stabilization device includes a stem and a boot coupled to the stem. The stem includes an elongated shaft extending from a first end to a second end, and an element extending radially outward from the second end of the shaft, the element having a stronger magnetic attraction than the shaft. The boot includes a spout having a central bore receiving the shaft, a surface of the bore defining an interior groove, and a cap formed integrally with the spout and defining an exterior groove intersecting the interior groove of the spout. The method also includes the step of providing a magnetic field adjacent the first glass pane of sufficient magnitude that the shaft of the stem is moved against the boot with sufficient force to deform the spout of the boot.

In some examples, providing the magnetic field includes placing a magnet adjacent to a surface of the first glass pane.

In some implementations, installing the pressure stabilization device includes installing the pressure stabilization device in a window spacer between the first and second glass panes of the insulated glass unit.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Many of the features are exaggerated to better show the features, process steps, and results. Like reference numbers and designations in the various drawings indicate like elements.

DETAILED DESCRIPTION

Figure 1B:
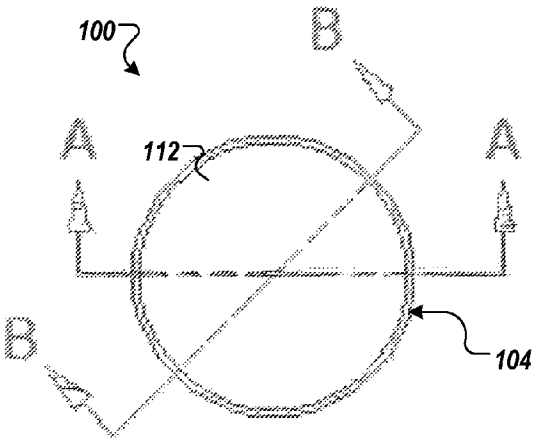
FIG. 1B is a top view of the pressure stabilization device of FIG. 1A.
Figure 1C:
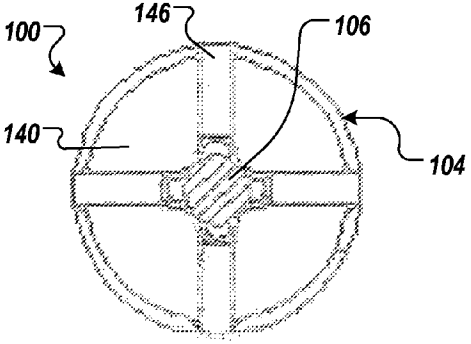
FIG. 1C is a cross-sectional view of the pressure stabilization device of FIG. 1A taken along the line C-C.
Figure 1A:
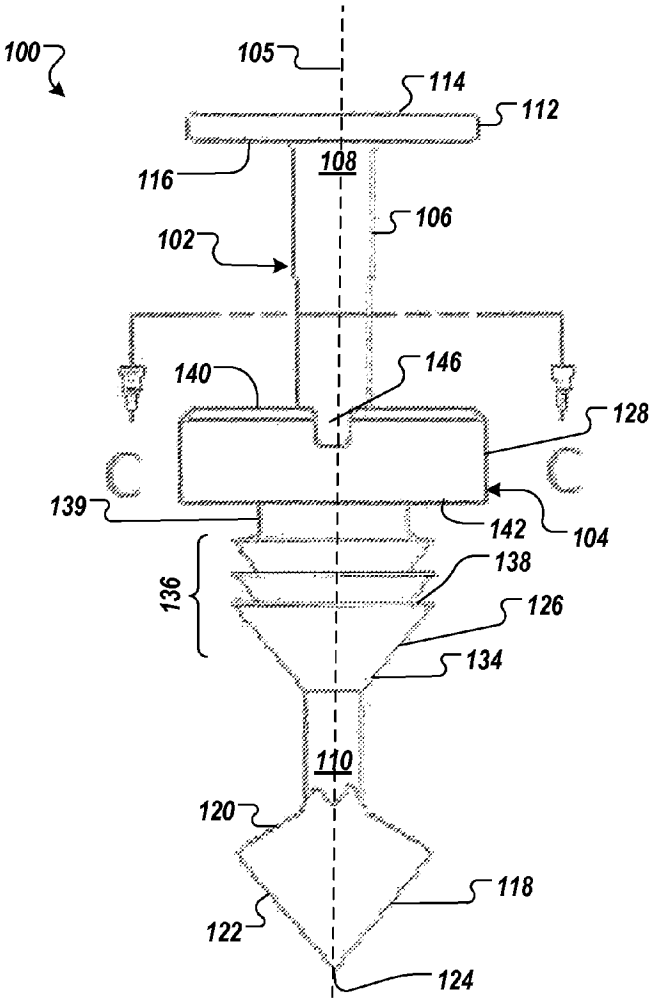
FIG. 1A is a side view of an example pressure stabilization device.
Figure 2A:
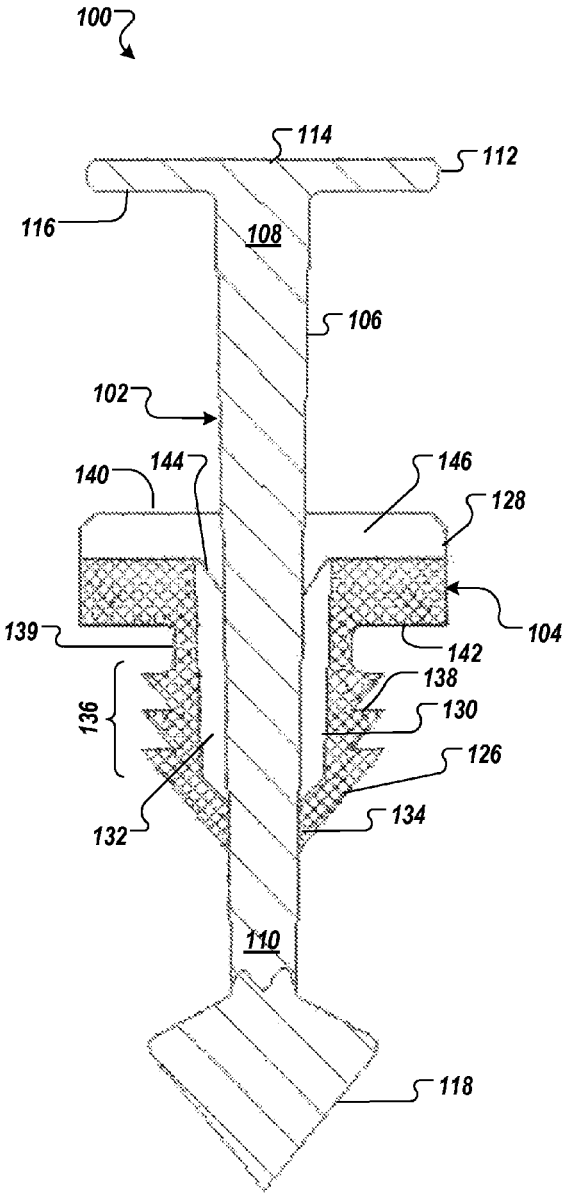
FIG. 2A is a cross-section view of the pressure stabilization device of FIG. 1A, taken along the line A-A, with the device in a pre-installed position.
Figure 2B:
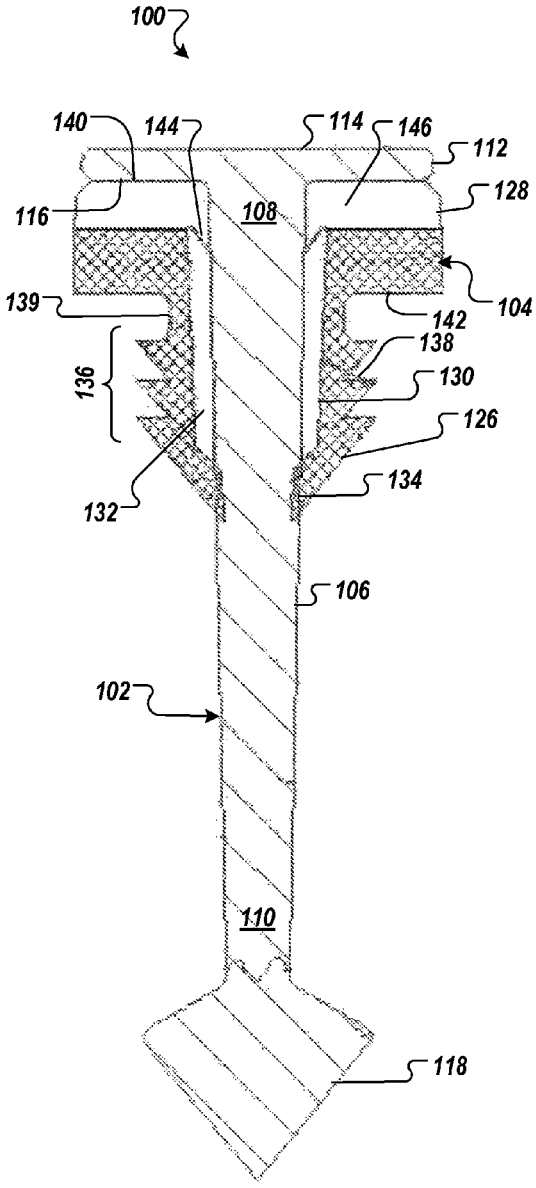
FIG. 2B is a cross-section view of the pressure stabilization device of FIG. 1A, taken along the line A-A, with the device in an installed position.
Figure 3A:
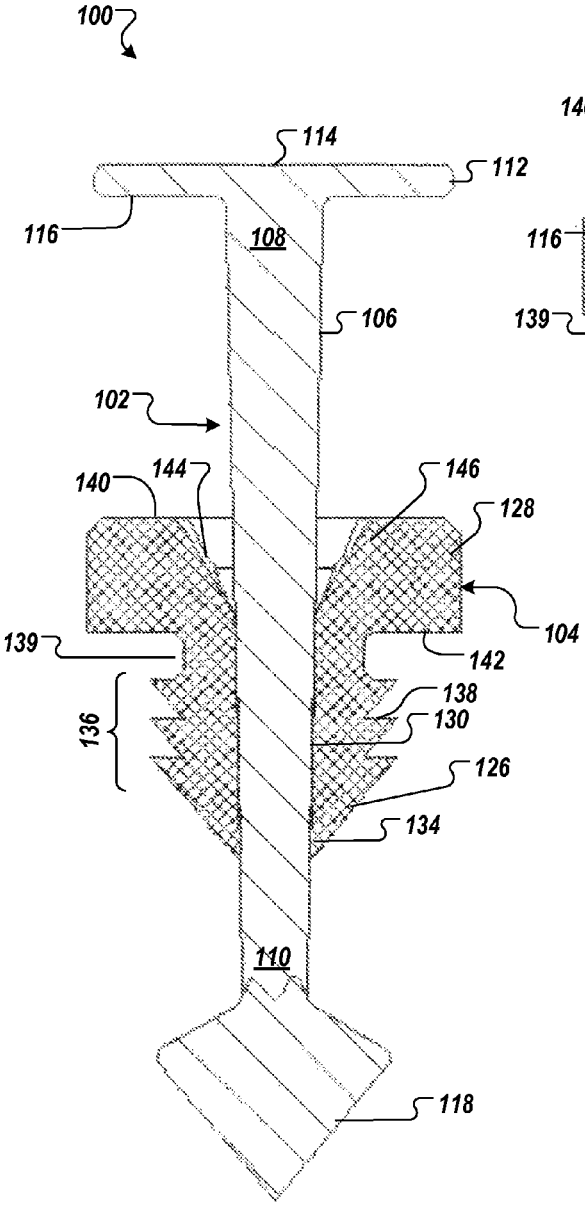
FIG. 3A is a cross-section view of the pressure stabilization device of FIG. 1A, taken along the line B-B, with the device in a pre-installed position.
Figure 3B:
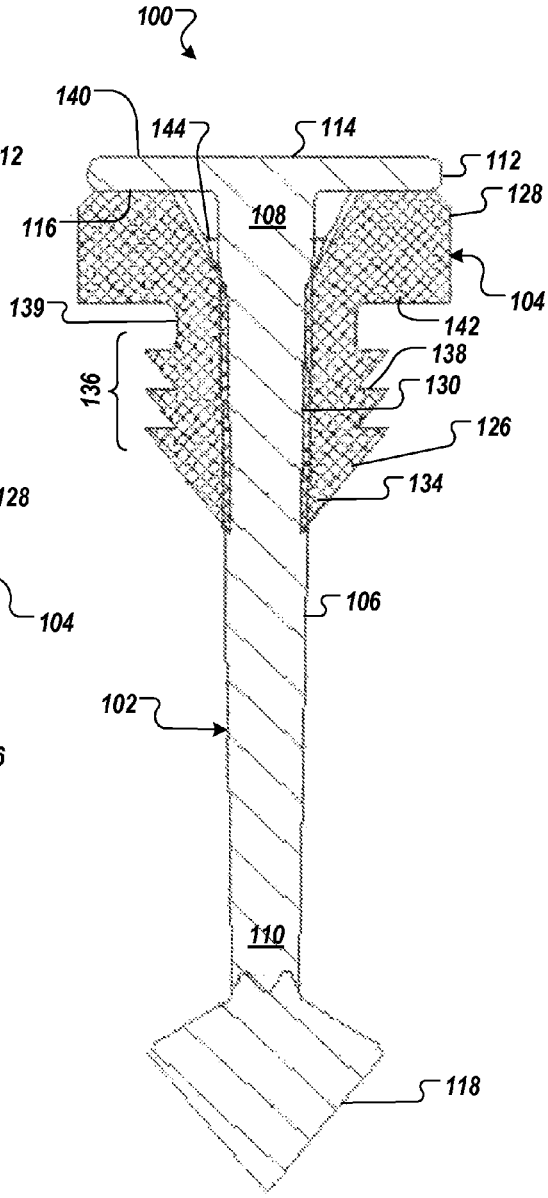
FIG. 3B is a cross-section view of the pressure stabilization device of FIG. 1A, taken along the line B-B, with the device in an installed position.

The present disclosure relates to pressure stabilization devices for use in sealed insulated glass units (IGUs), as well as various techniques for installation and use of such devices. The pressure stabilization devices described can resolve pressure differences between the encapsulated area of an IGU and its ambient surroundings by providing a valve to allow controlled ingress or egress of gas to or from the encapsulated area. Such pressure stabilization devices make possible techniques for installation and use that can be carried out by general laborers or tradesmen, as opposed to specialized service personnel.

Referring to FIGS. 1A-3B, an example pressure stabilization device 100 features a stem 102 and a boot 104. The boot 104 surrounds and receives a portion of the stem 102. Stem 102 is a rigid, solid body including a tapered cylindrical shaft 106 extending, along a longitudinal axis 105, from a wide end 108 to a narrow end 110. Shaft 106 is crowned at its wide end 108 by a head 112 centered about axis 105. Head 112 is a disc-shaped component defining a planar top surface 114 and a planer bottom surface 116. Head 112 projects directly from shaft 106, extending radially therefrom, such that bottom surface 116 forms an annular flange. In this example, head 112 is formed integrally with shaft 106, providing a monolithic structure. However, the head 112 could also initially be formed as a separate component, and subsequently coupled to the shaft 106 (e.g., permanently via welding, chemical bonding, adhesive, or detachably via mechanical fastening).

Stem 102 also includes an enlarged element 118, such as a tab, positioned at the narrow end 110 of shaft 106. "Enlarged" refers to the size proportionality of the element relative to the shaft, for example, the element is larger in cross-section than the narrow end 110 of the shaft 106 at a point just beyond the narrow end 110. In this example, element 118 is a conical-shaped structure, having a broad rounded base 120 leading to side surfaces 122 that converge to a narrow apex 124. However, other shapes are also contemplated and considered to be within the scope of the present disclosure. For example, the element 118 could be cubical, spherical, or cylindrical. Similar to the head 112 of the stem 102, the element 118 can be permanently or detachably coupled to the shaft 106.

Element 118 is a magnetically-attractable object exhibiting greater magnetic attractiveness than either of shaft 106 and head 112. Accordingly, in this example, element 118 and shaft 106 are fashioned from dissimilar materials, with the material of the element 118 being more attractive to magnetic force than the material of the shaft 106. In some cases, the material of the shaft 106 is paramagnetic or diamagnetic, and the material of the element 118 is ferromagnetic. In some implementations, the shaft 106 could be made of high grade stainless steel, and the element 118 could be made of a more ferrous metal, such as forged steel, for example. The same affect can be achieved by fashioning the element 118 and shaft 106 from the same material and applying a coating to either component (e.g., a magnetically attractable coating to the element or a non-magnetically attractable coating to the shaft). In some examples, the element material or coating exhibits a magnetic permeability greater than the dissimilar material or coating of the shaft. As a practical matter, a workable ratio of magnetic permeability can depend on various factors (e.g., the strength of the actuating magnetic field as well as the dimensions and materials of the IGU.

Boot 104 is movable along shaft 106 and retained on the shaft by head 112 and element 118. As shown, boot 104 includes a spout 126 integrally coupled to a cap 128, each of which is fashioned from a resilient polymer material (e.g., a material including rubber, such as silicone rubber, urethane rubber, and vinyl rubber). The material of the boot components is significantly more flexible than the material of the stem components, particularly the shaft of the stem. The boot material can be flexible enough to readily deform when stressed, and resilient enough to recover from multiple uses. In some implementations, the boot material is designed to function compatibly with conventionally sealants, inert gases and desiccant compounds typically used in sealed IGUs.

Spout 126 of boot 104 is a hollow cylindrical body having a central bore 130 that receives shaft 106. The diameter of bore 130 corresponds to the diameter of tapered shaft 106 inward of the shaft's narrow end 110, such that the bore 130 is slightly larger than the shaft 106 at the narrow end and significantly smaller than the shaft 106 at the wide end 108. Thus, in the pre-installed positions shown in FIGS. 2A and 3A, the boot 104 rests at a position along the shaft 106 where friction between the contacting surfaces of the bore 130 and the shaft 106 support its weight. In the pre-installed position, the spout 126 is not stressed by the shaft 106 and therefore exhibits no deformation. In the installed positions shown in FIGS. 2B and 3B, where the boot 104 is forced toward the wide end of the shaft 106, the surface of the shaft 106 presses firmly against the surface of the bore 130, causing the spout 126 to stretch to accommodate the wider portion of the shaft 106. In the installed position, the surface of the bore 130 forms a gas-tight seal against the shaft 106.

The surface of the bore 130 defines a plurality of interior grooves 132 that extend in the longitudinal direction of shaft 106 (i.e., along the direction of axis 105). In this example, there are four interior grooves positioned equidistant from one another along the circumference of the bore 130 (i.e., at 90° arc lengths along the bore). However, it is anticipated that there could be any number interior grooves, positioned in regular or irregular patterns, without departing from the scope of this disclosure. For example, there could be as few as one or as many as 15 interior grooves. Each of interior grooves 132 is closed at one end by an annular sealing ring 134 provided at the terminal portion of spout 126. "Closed" refers to the relationship between the interior grooves 132 and the shaft 106, for example, that the interior grooves 132 are sealed against the shaft 106 by the sealing ring 134 in the installed position. The opposite end of the interior grooves 132 remains open to intersect a corresponding exterior groove, as described below.

The interior grooves 132 are designed to convey gas either into or out of the encapsulated, sealed area of an IGU. Accordingly, in some examples, the interior grooves 132 are provided with curved surfaces (as opposed to straight surfaces with sharp corners), so as to mitigate frictional losses in the flowing gas. The cross-sectional area of the interior grooves 132 may vary between different implementations. For instance, the interior grooves 132 may have a larger cross-section when there are fewer grooves and a proportionately smaller cross-section when there are more grooves.

The outer surface of spout 126 defines a plurality of flexible, resilient barbs 136 designed to facilitate one-way insertion of the spout 126 into an opening. That is, the barbs 136 allow the spout 126 to be inserted into an opening, but inhibit removal of the spout 126 so as to retain the spout 126 in the opening. In this example, the spout 126 includes three retaining barbs 136. However, it is anticipated that any number of barbs can be provided without departing from the scope of the present disclosure.

Barbs 136 are frusto-conical shaped structures sloped inward toward the terminal portion of spout 126, such that the largest radial dimension at the base 138 is distal to the end of the spout 126. The slope of the barbs 136 combined with their flexible and resilient properties allows them to be compressed as the spout 126 is pressed into an opening, and to expand to their original shape on the other side of the opening. The base of the barbs 136 inhibits removal of the spout 126 from the opening. This aids in retaining the boot 104 in a desired position within a receiving structure.

The cap 128 of boot 104 is positioned at a distance from the barbs 136 to form a neck 139 between the structures. The neck 139 has a smaller diameter than the largest radial dimension of both the cap 128 and barbs 136 (e.g., the radial dimension at the base of the barbs 136).

Cap 128 is a cylindrical structure defining a top surface 140 that provides a seat for the bottom surface 116 of head 112 in the installed position. The cap 128 further defines a planar bottom surface 142 that seals against a mating surface of an IGU. Cap 128 defines a central bore 144 that meets with the bore 130 of spout 126. Bore 144 tapers radially outward to provide a larger opening at the cap's top surface 140.

Figures 4A, 4B, 4C:
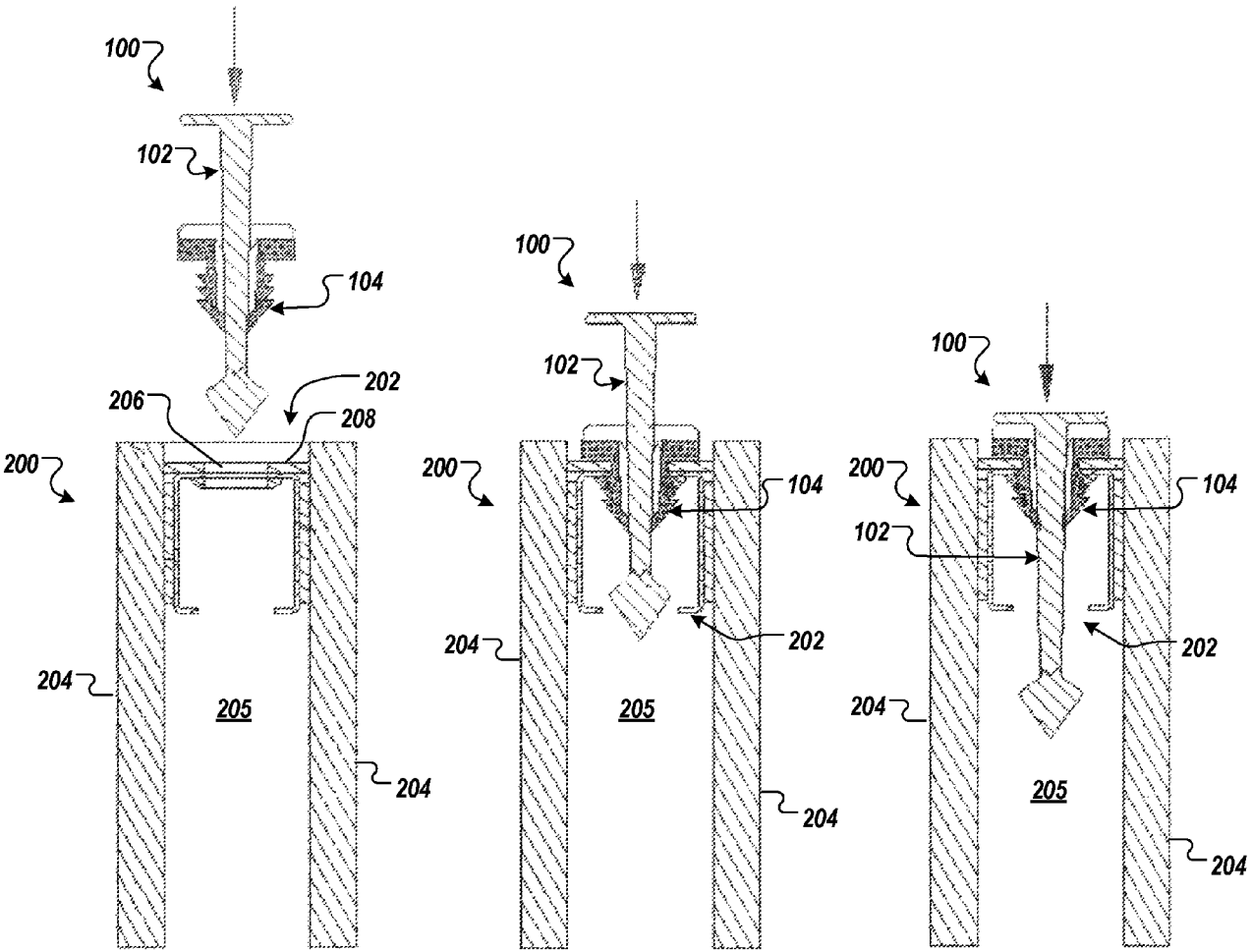
FIGS. 4A-4C are a progressive sequence of cross-sectional views illustrating the installation of a pressure stabilization device into an insulated glass unit.

A plurality of exterior grooves 146 are formed on the cap's top surface 140. Exterior grooves 146 are open at both ends, with one end being open to the surrounding environment and the opposite end intersecting interior grooves 132. Thus, in some implementations, there are an identical number of exterior grooves 146 as interior grooves 132. In some implementations, the exterior grooves 146 match the interior grooves 132 in shape and dimensions. So, for instance, the exterior grooves 146 can have the same cross-section as the interior grooves 132. FIGS. 4A-4C illustrate an installation technique for the pressure stabilization device 100 into an exemplary IGU 200. In particular, device 100 is installed on a window spacer 202 of IGU 200. The window spacer 202 is positioned between adjacent glass panes 204, forming an encapsulated area 205. As shown in FIG. 4A, device 100 is positioned over spacer 202, and aligned with an opening 206 defined in the spacer 202. Device 100 is then inserted into the opening 206. For example, a user pushes the element 118 and boot 104 through the opening 206 until the device 100 is seated into the spacer 202 as shown in FIG. 4B. FIG. 4B also shows how the boot 104 interfaces or cooperates with the spacer 202, such that the cap 128 is seated on a flange surface 208 of the spacer 202 and the spout 126 is positioned on the opposite side of opening 206. The bottom surface 142 of the cap 128 seals against the flange surface 208. The neck 139 of the spout 126 is embraced by the surrounding edge of opening 206 and held in place between the cap 128 and the retaining barbs 136. As shown in FIG. 4C, device 100 is moved to the installed position by pressing the head 112 of stem 102 downward, so that the head's bottom surface 116 sits against the cap's top surface 140. As noted above, in the installed position, the surface of the bore 130 of the spout 126 forms a gas-tight seal against the shaft 106, and the interior grooves 132 are closed by the annular sealing ring 134, which prevents gas egress or ingress from or into, respectively, the encapsulated area 205.

Figure 5:
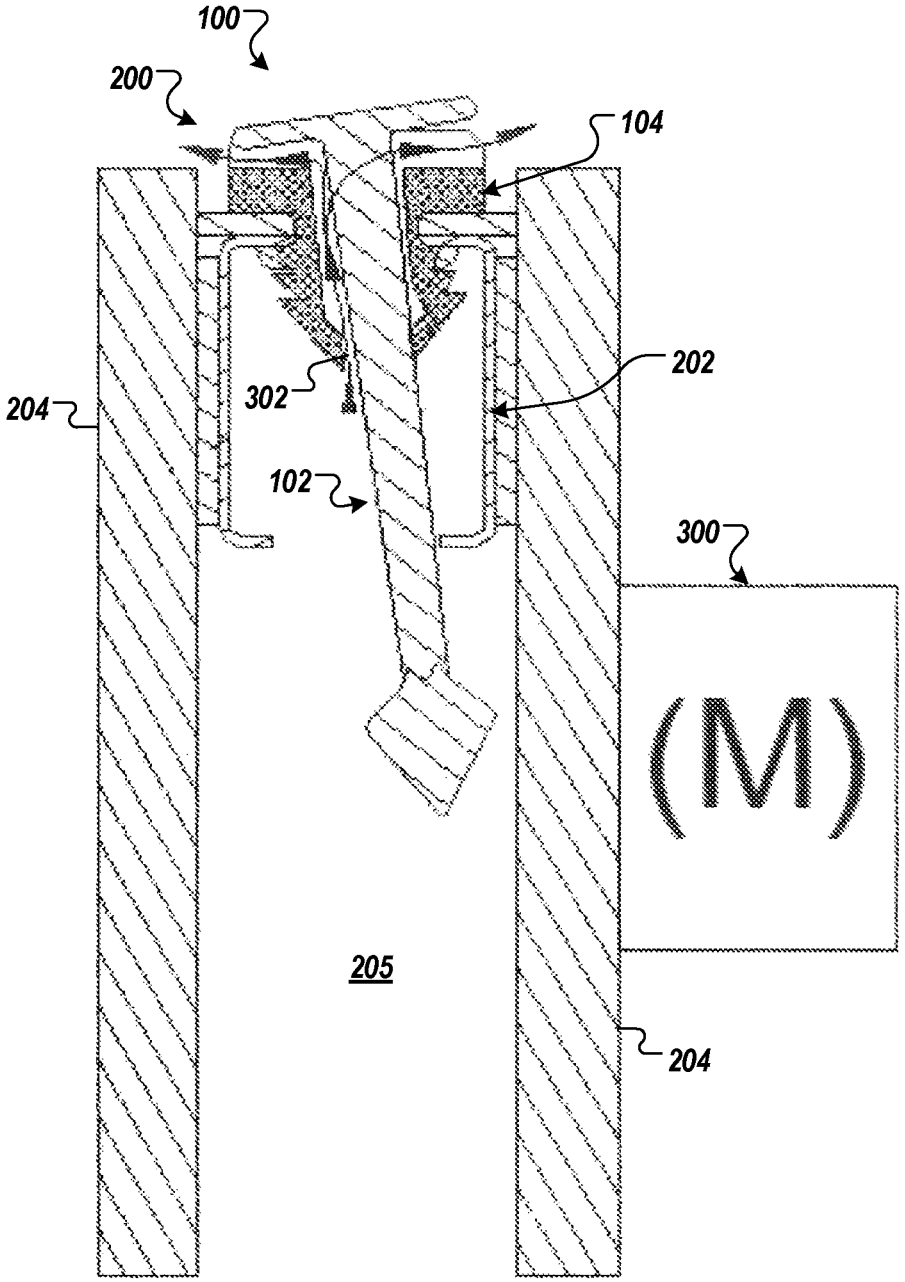
FIG. 5 is a cross-sectional view illustrating actuation of a pressure stabilization device installed in an insulated glass unit.

FIG. 5 illustrates magnetic actuation of the pressure stabilization device 100. As shown, to actuate device 100, a magnet 300 is placed adjacent to a surface of one of the IGU glass panes 204, such that the magnetic field attracts the element 118. Of course, the magnetic field can be provided in various other ways, e.g., via electromagnetic induction. In any event, the magnetic field is of sufficient strength to pull the element 118 towards the magnet 300, which torques shaft 106 to a tilted position. Shaft 106 bears against boot 104 causing deformation in the spout 126 of a degree sufficient to opens a leak passage 302 between the annular sealing ring 134 and the surface of shaft 106. Leak passage 302 opens to one or more of the interior grooves 132, allowing gas to freely ingress or egress to or from, respectively, the encapsulated area 205 (via a path from the interior grooves 132 to the intersecting exterior grooves 146) until the pressure in the encapsulated area 205 equalizes with the ambient pressure.

The devices and techniques described in the present disclosure offer numerous advantageous. For example, in many IGU designs, the spacer is made of thin sheet metal which must be screwed together at one corner. This screw could easily be replaced by the above described pressure stabilization device, requiring little to no additional fabrication or modification to the existing spacer. Also, the natural position of the pressure stabilization device is to remain closed, which provides an advantage over conventional capillary tubes that default to an open position. Further, the magnetic actuation of the pressure stabilization device requires no disassembly of the IGU, which is not the case with capillary tubes or other designs that require a puncture into the side of the spacer after the IGU is installed.

The use of terminology such as "front," "back," "top," "bottom," "over," "above," and "below" throughout the specification and claims is for describing the relative positions of various components of the device and other elements described herein. Similarly, the use of any horizontal or vertical terms to describe elements is for describing relative orientations of the various components of the device and other elements described herein. Unless otherwise stated explicitly, the use of such terminology does not imply a particular position or orientation of the system or any other components relative to the direction of the Earth gravitational force, or the Earth ground surface, or other particular position or orientation that the system other elements may be placed in during operation, manufacturing, and transportation.

A number of implementations have been described. Nevertheless, it will be understood that various modifications may be made without departing from the spirit and scope of the specification and the following claims.

The invention claimed is:

1. A pressure stabilization device for an insulated glass unit, the device comprising:

a stem comprising:

an elongated shaft extending from a first end to a second end; and an element extending radially outward from the second end of the shaft, the element having a stronger magnetic attraction than the shaft, wherein the element and the shaft are fashioned from a dissimilar materials; and a boot coupled to the stem, the boot comprising:

a spout having a central bore receiving the shaft, a surface of the bore defining an interior groove; and a cap formed integrally with the spout and defining an exterior groove intersecting the interior groove of the spout.

2. The device of claim 1, wherein the stem further comprises a head extending radially outward from the first end of the shaft.

3. The device of claim 1, wherein the shaft comprises a cylindrical body tapering in diameter from the first end to the second end.

4. The device of claim 1, wherein the element comprises a conical-shaped body, having a broad rounded base leading to side surfaces that converge to a narrow apex.

5. The device of claim 1, wherein the stem comprises a paramagnetic material.

6. The device of claim 1, wherein the element comprises a ferromagnetic material.

7. The device of claim 1, wherein the boot is more flexible than the stem, such that forcing the stem against the boot causes the boot to deform.

8. The device of claim 1, wherein the spout terminates in an annular sealing ring configured contact a surface of the shaft to seal a distal end of the interior groove away from the intersection with the exterior groove of the cap.

9. The device of claim 1, wherein the outer surface of the spout defines a radially extending retaining barb configured to allow the boot to be inserted into an opening of the insulated glass unit, and to inhibit removal of the boot from the opening.

10. A window assembly, comprising:

an insulated glass unit comprising a first glass pane and a second glass pane separated by a window spacer; and a pressure stabilization device installed in the window spacer, the pressure stabilization device comprising:

a stem comprising:

an elongated shaft extending from a first end to a second end; and an element extending radially outward from the second end of the shaft, the element having a stronger magnetic attraction than the shaft, wherein the element and the shaft are fashioned from a dissimilar materials; and a boot coupled to the stem, the boot comprising:

a spout having a central bore receiving the shaft, a surface of the bore defining an interior groove; and a cap formed integrally with the spout and defining an exterior groove intersecting the interior groove of the spout.

11. The window assembly of claim 10, wherein the stem further comprises a head extending radially outward from the first end of the shaft.

12. The window assembly of claim 10, wherein the shaft comprises a cylindrical body tapering in diameter from the first end to the second end.

13. The window assembly of claim 10, wherein the element comprises a conical-shaped body, having a broad rounded base leading to side surfaces that converge to a narrow apex.

14. The window assembly of claim 10, wherein the boot is more flexible than the stem, such that forcing the stem against the boot causes the boot to deform.

15. The window assembly of claim 10, wherein the spout terminates in an annular sealing ring configured contact a surface of the shaft to seal a distal end of the interior groove away from the intersection with the exterior groove of the cap.

16. The window assembly of claim 10, wherein the outer surface of the spout defines a radially extending retaining barb configured to allow the boot to be inserted into an opening of the insulated glass unit, and to inhibit removal of the boot from the opening.

17. A method of stabilizing the pressure of an insulated glass unit, the method comprising:

installing a pressure stabilization device between a first and second glass pane of the insulated glass unit, the pressure stabilization device comprising;

a stem comprising:

an elongated shaft extending from a first end to a second end; and an element extending radially outward from the second end of the shaft, the element having a stronger magnetic attraction than the shaft; and a boot fashioned from a resilient material coupled to the stem, the boot comprising:

a spout having a central bore receiving the shaft, a surface of the bore defining an interior groove; and a cap formed integrally with the spout and defining an exterior groove intersecting the interior groove of the spout; and providing a magnetic field adjacent the first glass pane of sufficient magnitude that the shaft of the stem is moved against the boot with sufficient force to deform the spout of the boot.

18. The method of claim 17, wherein providing the magnetic field comprises placing a magnet adjacent to a surface of the first glass pane.

19. The method of claim 17, wherein installing the pressure stabilization device comprises installing the pressure stabilization device in a window spacer between the first and second glass panes of the insulated glass unit.

* * * * *